US005966892A

United States Patent [19]

Platt

[11] Patent Number: 5,966,892

[45] Date of Patent: Oct. 19, 1999

[54] READY TO ASSEMBLE WOOD CONSTRUCTION SYSTEM

[76] Inventor: R. Terry Platt, 706 Airport Rd., Blacksburg, Va. 24060

[21] Appl. No.: 08/788,990

[22] Filed: Jan. 27, 1997

[51] Int. Cl.[6] ..... E04B 1/38

[52] U.S. Cl. ..... 52/712; 52/715; 403/386; 403/389

[58] Field of Search ..... 52/717, 712, 713, 52/714, 715, 642; 403/386, 388, 389; 411/457, 458, 460–465

[56] References Cited

U.S. PATENT DOCUMENTS

| | | | |
|---|---|---|---|
| 2,117,308 | 5/1938 | Frey | 411/461 |
| 2,339,841 | 1/1944 | Deuchler et al. | 411/466 X |
| 2,903,879 | 9/1959 | Williams | 52/713 X |
| 3,449,997 | 6/1969 | Louch | 52/713 X |
| 4,679,307 | 7/1987 | Geisthardt | 411/458 X |
| 5,006,006 | 4/1991 | Lehtonen | 52/712 X |
| 5,391,114 | 2/1995 | De Groot . | |
| 5,622,022 | 4/1997 | Haisch | 52/713 |
| 5,640,822 | 6/1997 | Haswell | 52/712 |

FOREIGN PATENT DOCUMENTS

| | | | |
|---|---|---|---|
| 359715 | 9/1922 | Germany | 411/464 |
| 3238493 | 8/1983 | Germany | 411/457 |
| 1201449 | 12/1985 | Russian Federation . | |
| 1689540 A1 | 11/1991 | Russian Federation . | |
| 1705522 | 1/1992 | Russian Federation . | |
| 99140 | 5/1923 | Switzerland | 403/389 |
| 128555 | 6/1919 | United Kingdom | 411/461 |

*Primary Examiner*—Creighton Smith

[57] ABSTRACT

A ready to assemble construction system for erecting small structures such as houses, sheds, garages, etcetera. Comprising specially designed connecting plates which both secure laminate sections of lumber to each other to form constructive elements and also act as a rigid connecting means between the elements to enable the structure to be easily, quickly, and inexpensively built and later disassembled if necessary.

16 Claims, 10 Drawing Sheets

59
55
54
56
58
57
52
51
50
44
45
46
47
43
42
41
40
37
35
34
36
33
31
30
32

READY TO ASSEMBLE WOOD CONSTRUCTION SYSTEM

This invention concerns a ready to assemble construction system (RTA) which is comprised of easily manufactured components which can utilize engineered wood products or solid sawn lumber. The engineered wood or solid sawn lumber, when combined with rigid attachment mechanisms, constitute a superior and low cost construction system which readily allows unskilled individuals in the construction trades to build a wide variety of structures and subassembly components. The key to the system is the connector plates which allows building component cross sections to be increased by mechanical lamination of small cross-sectional lumber, while simultaneously providing a superior component attachment mechanism.

One of the problems associated with wood construction has been the high and widely varying cost of wood coupled with the decreasing quality of the available timber supply. Some say this is because of the scarcity and others say it is because of the concentration of a few wood wholesalers in the market. Whatever the reason the last several decades have seen a search for substitutes for expensive construction wood which are less costly yet have the same desirable characteristics as wood.

The main reason for wanting to employ wood or wood product is that wood is a renewable resource which will not skyrocket in price due to finite amounts being available. The old growth forests have been, in the main, stripped badly with little total growth left. This fact negates any future use of superior old growth timber such as pine, oak, poplar, yellow birch or ash for construction material. The cheaper woods are imperfect at best and do not afford the uniform stress and bending characteristics desired in building materials. The cheaper woods are better utilized by making engineered wood products out of them such as, laminated veneer lumber (LVL), laminated strand lumber (LSL) and parallel strand lumber (PSL). Engineered wood products use a lower grade of wood yet offer greater strength and dimensional stability than their solid sawn lumber counterparts. The invention contemplates the use of engineered wood and/or solid sawn lumber.

The imperative for seeking cheaper and more reliable methods of habitat construction is that it is estimated that the world population of 5 billion people will double every 39 years based on the 1990 birth rate. This results in a net gain of 250,000 people per day, an astounding figure. How does government and business insure that adequate housing be found for these people? Surely the answer lies with cheap, sturdy and easy to assemble housing. The invention addresses this need by providing a means to rapidly construct a structurally sound dwelling with a small crew of unskilled labor using common hand tools. With two of the wood fastening methods, namely gluing and hand joinery, necessitating skilled labor, the most popular method is mechanical fastening. The range of mechanical fastening extends from simple nailing to the invention, the RTA construction system. The RTA system affords ease of transport of the system to the job site, low labor costs in terms of skill level and time involved in constructing the structure, low capital outlay in terms of production, superior resistance to uplift forces generated by high force winds such as hurricanes and tornadoes and the ability to rapidly assemble, disassemble and reassemble structures. Factory production of the components of this system is designed to be low tech lessening the upfront capital outlay.

GENERAL DESCRIPTION OF THE INVENTION

The invention contemplates the use of improved connector mechanisms which are in and of themselves inexpensive to manufacture and are more than justified in terms of the labor time they eliminate in system assembly. The RTA connector laminates less expensive small dimension lumber into large product components capable of carrying structural loads which previously required expensive large wood products. The combination attachment and binding plates are made of a low grade steel or other suitable material and have a series of holes drilled therein to receive either pressed nails or elongated bolts for securing together two or more wood products together to produce one large member. This configuration approximates the load capability of the old post and bean construction and allows for that very method of construction in lieu of the standard platform framing method used today. The RTA system invention can use varying grades of lumber, from high to low quality, depending on the end use application. The simultaneous pressing of a nail plate with multiple nails is more resistant to wood splitting than the common practice of driving one nail at a time.

BACKGROUND ART

It is not believed there has been any prior attempts to accomplish what the RTA system invention does. The Center for Research Engineering and Manufacturing Building Systems in Kirov, Russia has developed and patented (in Russia) a nail plate connector which is used to laminate wood products. Several Russian patents are provided herewith which show this configuration. Generally, the Russian method of attaching laminates is designed around a plate with nails welded to the edges of the plate. Welding of nails on the plate perimeter limits nail placement, which limits the magnitude of stress that the plate can resist. The RTA connector differentiates from the Russian method inasmuch as it provides for locating the nails in the interior of the plate. Interior nail placement provides greater flexibility in plate design for the specific stresses that the nail plate assemblies must resist. Experiments have demonstrated that nails located in the plate interior will effectively resist shear stresses that can break the welds on the Russian nail plate. A great difference is that the RTA invention acts as a moment resistant connection between component laminate members. The nails in the RTA invention are friction fit not welded which resist sheer much more readily under tests conducted on the products. The RTA design is a result of testing components after design to insure that loads typically encountered can be accommodated without failure of the plate/member connection. This has dictated the interior located three/two parallel nail patterns which are found to be superior to edge nail fastening and other configurations.

OBJECTS OF THE INVENTION

Accordingly, it is an object of this invention to provide an improved mechanical fastening system for wood construction that facilitates a rapid and easy assemble by persons unskilled in construction methods.

It is still another object of this invention to provide a superior fastening system utilizing laminated wood or wood products to lower the overall cost of construction.

It is yet another object of this invention to provide for an assembly system for structures which can readily be disassembled to be used again in other assemblies.

Another object of this invention is to provide an assembly system which is suitable for all light frame construction such as houses, shed, garages, etc.

Yet another object of this invention is to provide a minimum of attachment mechanisms which will allow the component wood product members to be attached one to another in a simple, strong and efficient manner.

Still another object of this invention is to provide an improved fastener for framing structures which acts as a clamp to secure wood product components together for strength and acts as a superior attachment mechanism for these wood product components.

These and other objects will become readily apparent when reference is made to the accompanying drawings in which:

FIG. 1 is a cross sectional view showing two laminate wood members joined to an attachment plate by a series of nails, and FIGS. 2*a* and 2*b* show plan view of perpendicular-to-grain connection and parallel-to-grain connections respectively, and FIGS. 3*a*, 3*b* and 3*c* show three variations for plate members in built up laminate members, and FIG. 4 shows a diagrammatic view of a truss configuration with the nail plates as pinned connectors, and FIG. 5 shows a column to rafter connection of 30 degrees using a pivot connection, and FIG. 6 shows a connector plate used to provide multiple column support in a structure, and FIGS. 7*a*, 7*b* and 7*c* show plans views of an L, a T and a Cross shaped attaching plates, respectively, on wood component members, and FIG. 8 shows the three stages of component fabrication using the ready to assemble connector, and FIG. 9 shows the joint layout partially assembled, and FIG. 10 shows the layout of FIG. 9 bolted in place, and FIG. 11 is a photograph showing the components as they arrive on a job site, and FIG. 12 is a photograph showing the component layout on the job site, and FIG. 13 is a photograph of a partially assembled frame, and FIG. 14 is a photograph of an assembled frame, and FIG. 15 shows the use of panels to attach to the framing members of FIG. 14 which enclose the structure.

DETAILED DESCRIPTION OF THE INVENTION

Figure 14:
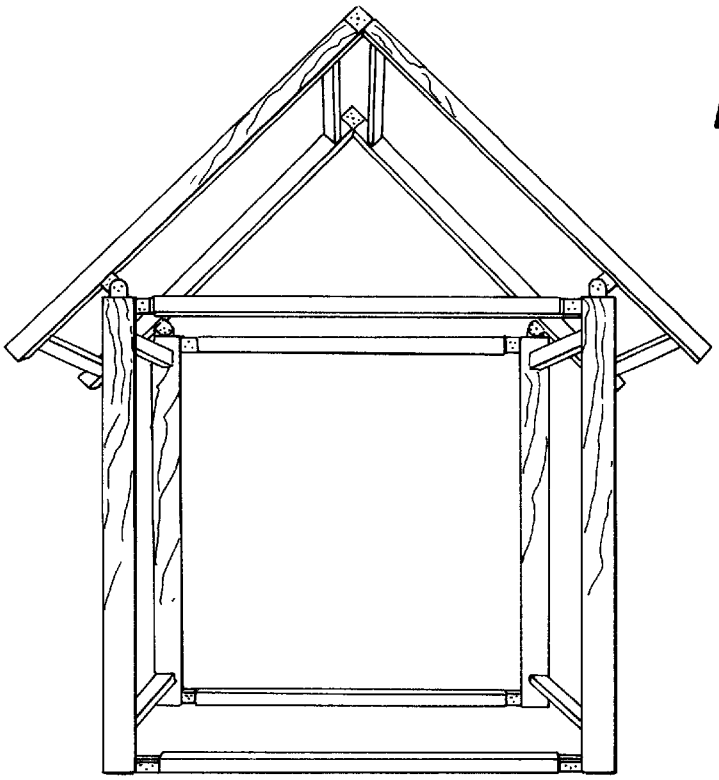
Figure 15:
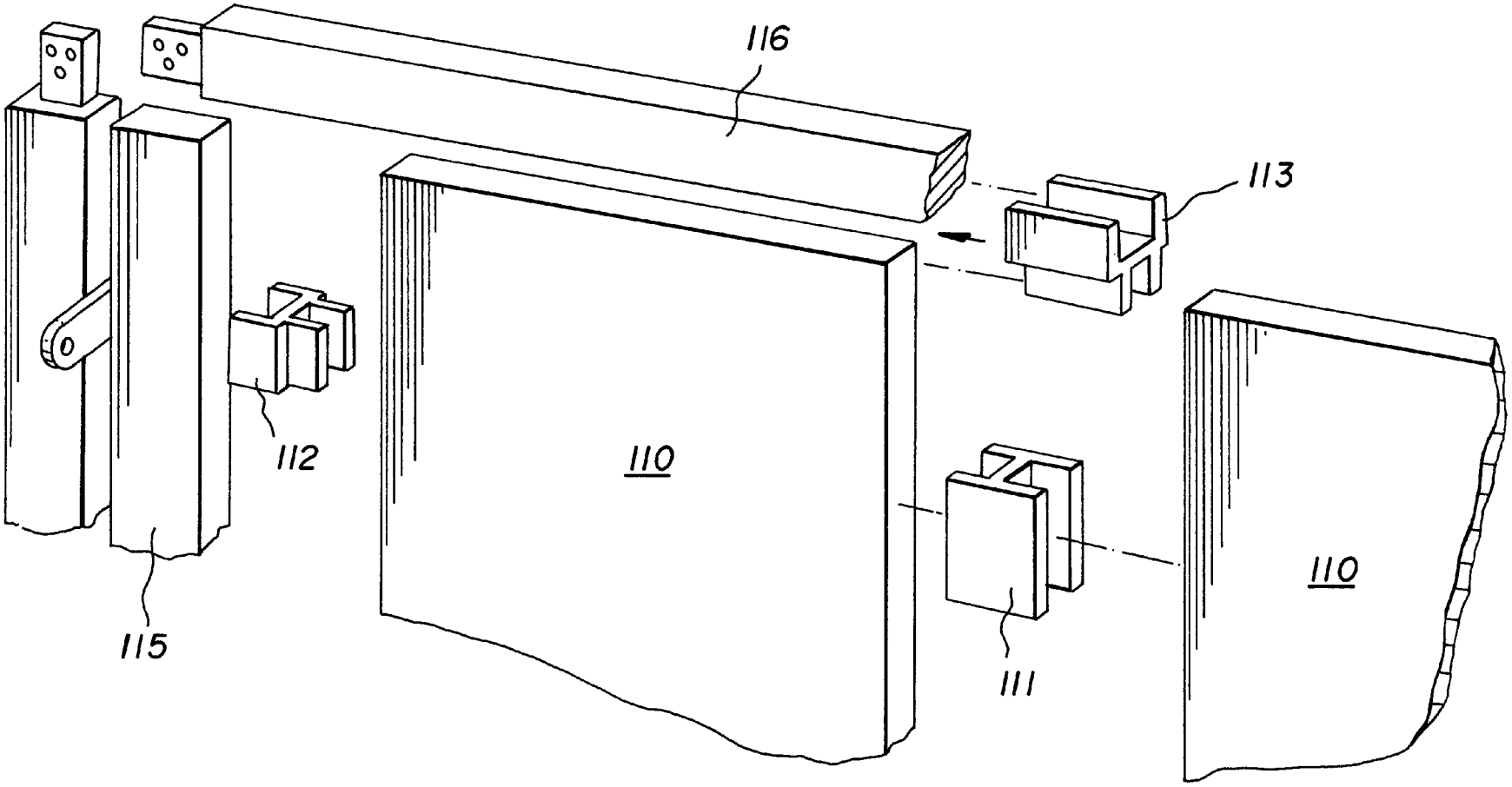

Referring now to the photographs represented by FIGS. 10 through 15 it is seen that the members incorporating the RTA system invention come to the job site all assembled with their attachment mechanisms. They are laid out as in FIG. 11 and are assembled one at a time as in FIG. 12. FIGS. 14 and 15 show the assembled components in the form of the frame for an assembled shed.

Figure 1:
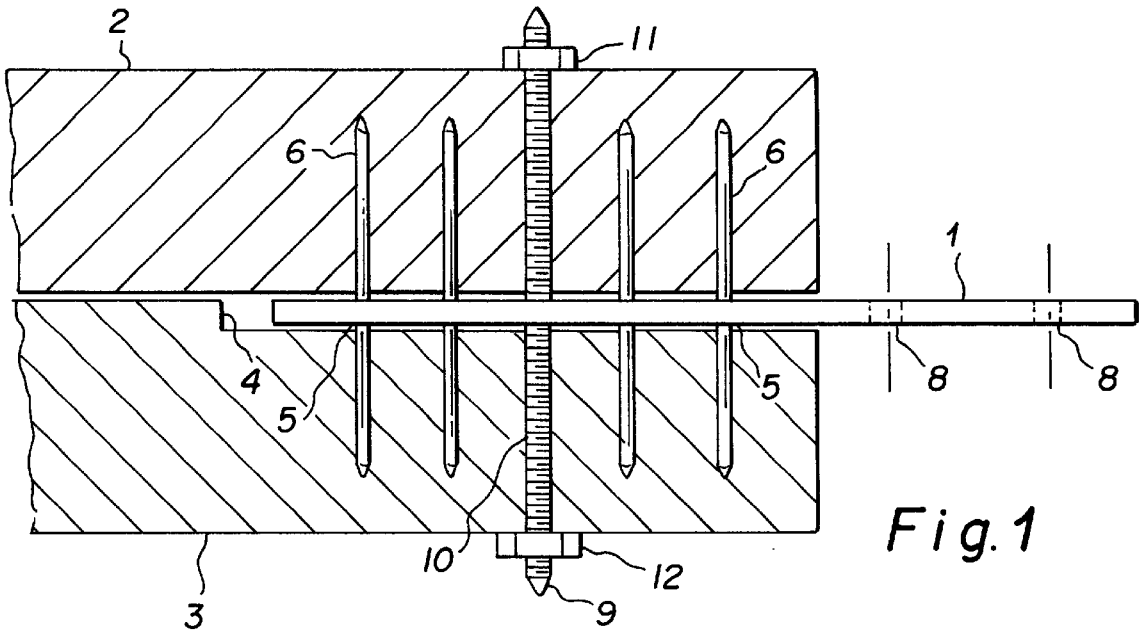

Referring now to FIG. 1 there is shown a cross sectional view which encapsulates this invention. An attachment plate is shown at 1 which is positioned between two layers of wood members 2 and 3. One member 3 is cut away as at 4 to allow for positioning of the plate 1. Plate 1 which has a securing portion extending between the laminate sections of wood members 2 and 3 and a connecting portion extending outwards therefrom. The connecting portion has apertures therein which are adapted to receive fasteners to secure the connecting portions together to prevent movement of one member relative to another has a series of holes 5 therein through which nails 6 are positioned and which, in turn, are driven into members 2 and 3. Plate 1 has predrilled holes 8 therein for receiving bolts (not shown) which bolt the plates together in a predetermined angle. As an option a threaded elongated bolt 9 is located in predrilled hole 10 for adding rigidity to the connection. An additional option is to secure the threaded elongated bolt 9 to the plate 1 with a weld at the rod plate interface. Both ends of the rod would be sharpened so that the entire plate 1 could be pressed into the wood members 2 and 3 without the necessity of pre-drilling. Compression nuts 11 and 12 enable one to tightly secure the plate 1 and the two members together but it is generally not used unless large stresses are encountered. The bolting of two or more wood members together enables one to achieve the rigidity and strength of large cross sectional members as in post and beam construction without the expense of purchasing the beams themselves. The nails are driven into the holes in the plates which are drilled out and slightly undersize for the nails allowing for a press fit. Instead of the press fit the nails may be welded in place but this is a more expensive process. The elongated bolt 9 shown in FIG. 1 may be used in lieu or in combination with the nails in the plate and would pass through predrilled holes and be secured as shown. The option exists for pressing one or more elongated bolts with sharpened ends without the need for pre-drilling. Several of these elongated bolts can be used for each plate depending on the strength of the connection desired.

Figure 2A:
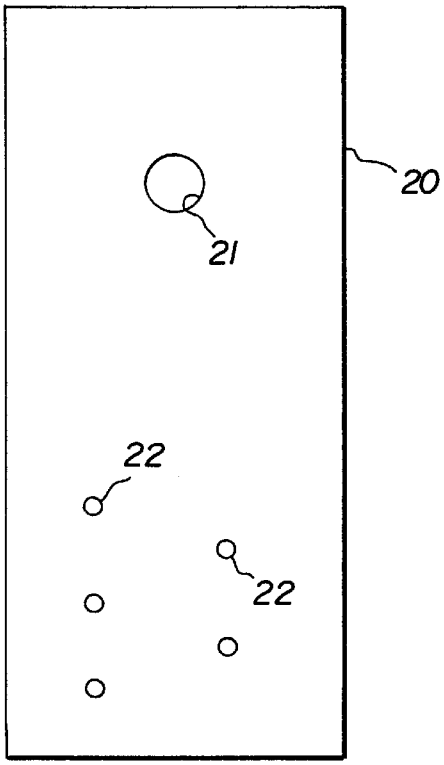
Figure 2B:
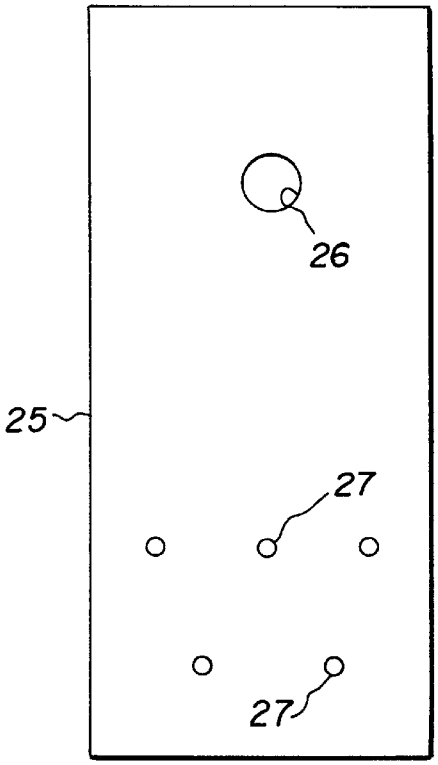

FIG. 2 shows sample plate plan views. FIG. 2*a* shows the perpendicular-to-grain connection layout of a plate 20 with center fastening bolt holes 21 and a series of holes 22 aligned in two parallel rows which facilitates nailing the plate to a wood member with the grain running perpendicular to the long axis of the plate. FIG. 2*b* shows parallel-to-grain connection layout of a plate 25 with center bolt fastening hole 26 and a series of holes 27 aligned in parallel rows running crosswise to the grain of the wood member to which it is designed to be attached. The alignment of the holes 22 and 27 are designed so as not to cause splitting of the members when the nails are attached to the plates and forced into the wood by the initial pressing and the subsequent driving.

Figures 3A, 3B, 3C:
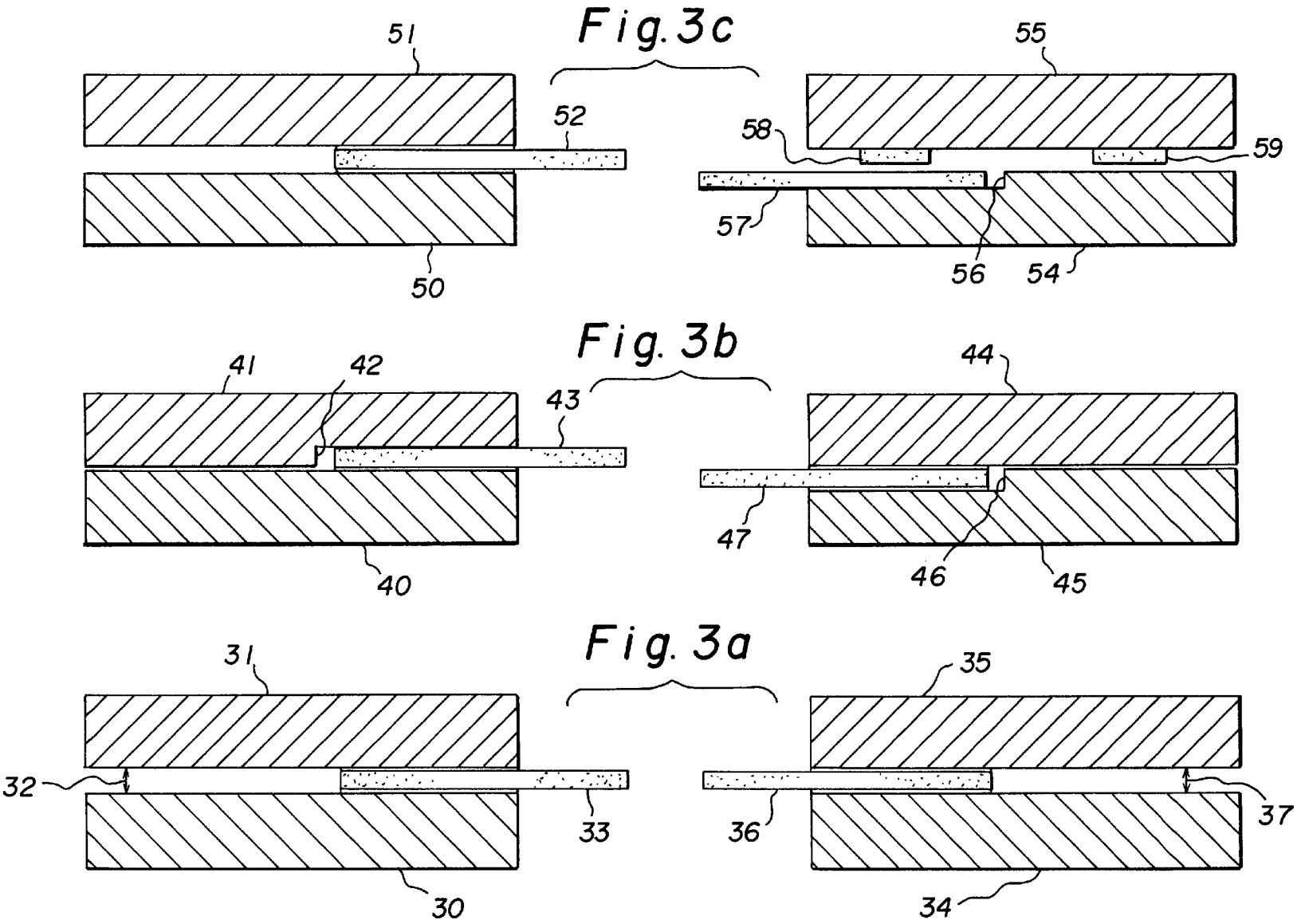

FIG. 3 shows three options for plate positioning when pressing the wood and connector plate together. Each plate has a securing portion which fits between the laminate sections and a connecting portion which extends outwardly therefrom to engage, by the use of fasteners, another connecting portion FIG. 3*a* shows the members 30, 31 pressed together on plate 33 which leaves space 32. Plate 36 is pressed between members 34 and 35 which creates space 37. Naturally the members are somewhat offset relative to one another when the plates 33 and 36 are joined. FIG. 3*b* shows members 41 and 45 being routed out to provide spaces 42 and 46, respectively, for connector plates 43 and 47. This allows for flush abutting of members 40 and 41 and members 44 and 45. FIG. 3*c* shows members 50 and 51 being pressed together on plate 52 in a fashion similar to those connections in FIG. 3*a* Plate 52 will mate with plate 57 which is located in a routed area of member 54 which, in turn, is spaced from member 55 by spacers 58 and 59. This arrangement allows for the assembly of multiple laminated components at one point while maintaining the same centerline for all components. A further option not shown is to route both members to ½ the depth of the plate member so that the surfaces of the members come together when the assembly is pressed together.

Figure 4:
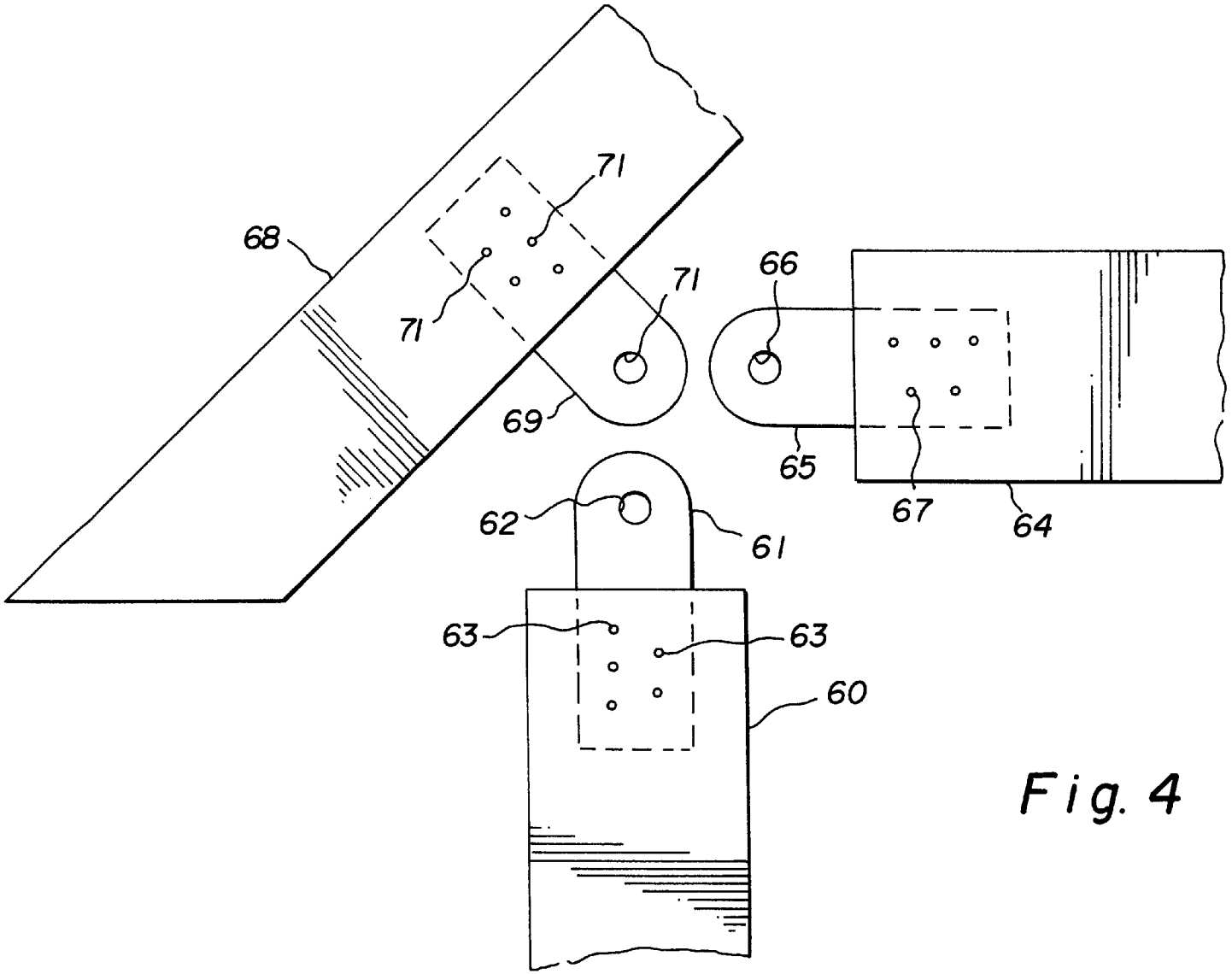
Figure 5:
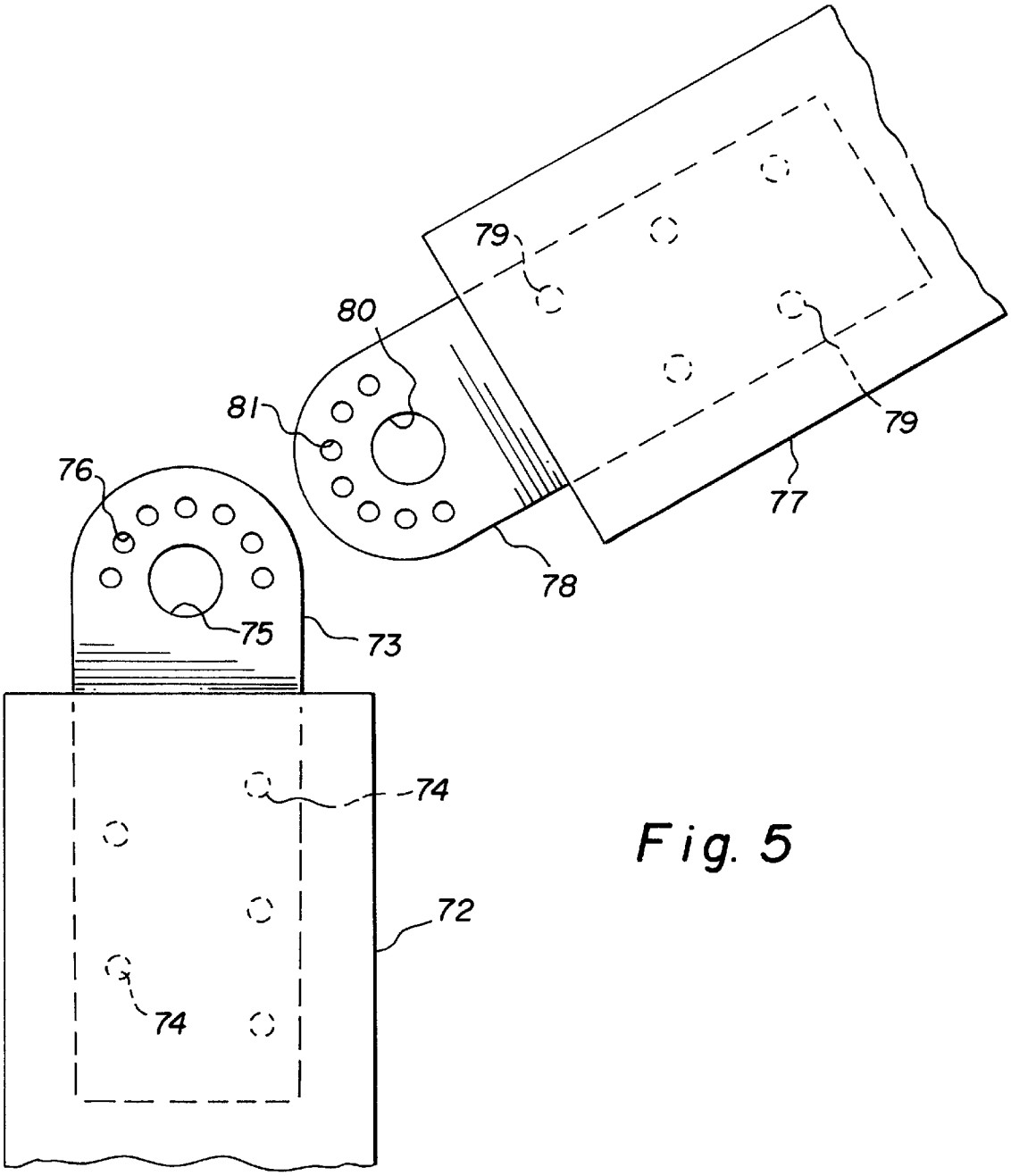

FIG. 4 shows three members, column 60, bottom chord 64 and top chord 68 positioned prior to fastening. Shown by the dotted lines inserted in the members are plates 61, 65 and 69, respectively. Each plate has a center hole 62, 66 and 71, respectively, for receiving a bolt to secure the members together. Each plate is secured to the laminated members by nails 63, 67 and 71 which secure the laminated members together on the plate. In lieu of the center one bolt hole additional smaller holes may be place around the center hole as it FIG. 5 so as to lock the plates against slippage relative to one another. In that figure, column member 72 has a connector plate 73 fastened therein by nails 74 and is rounded on the end to enclose a center bolt hole 75 designed, together with hole 80 in plate 78, to be bolted together. Annular holes 76 and 81 are designed to match up to receive a smaller bolt or shear pin to keep the plates from slipping relative to one another. Nails 79 secure plate 78 to rafter member 77 which is designed to be secured to column member 72 at a 30 degree angle as shown but can be designed to accommodate any angle by shear pin placement, which affords a rigid moment resisting type of connection.

Figure 6:
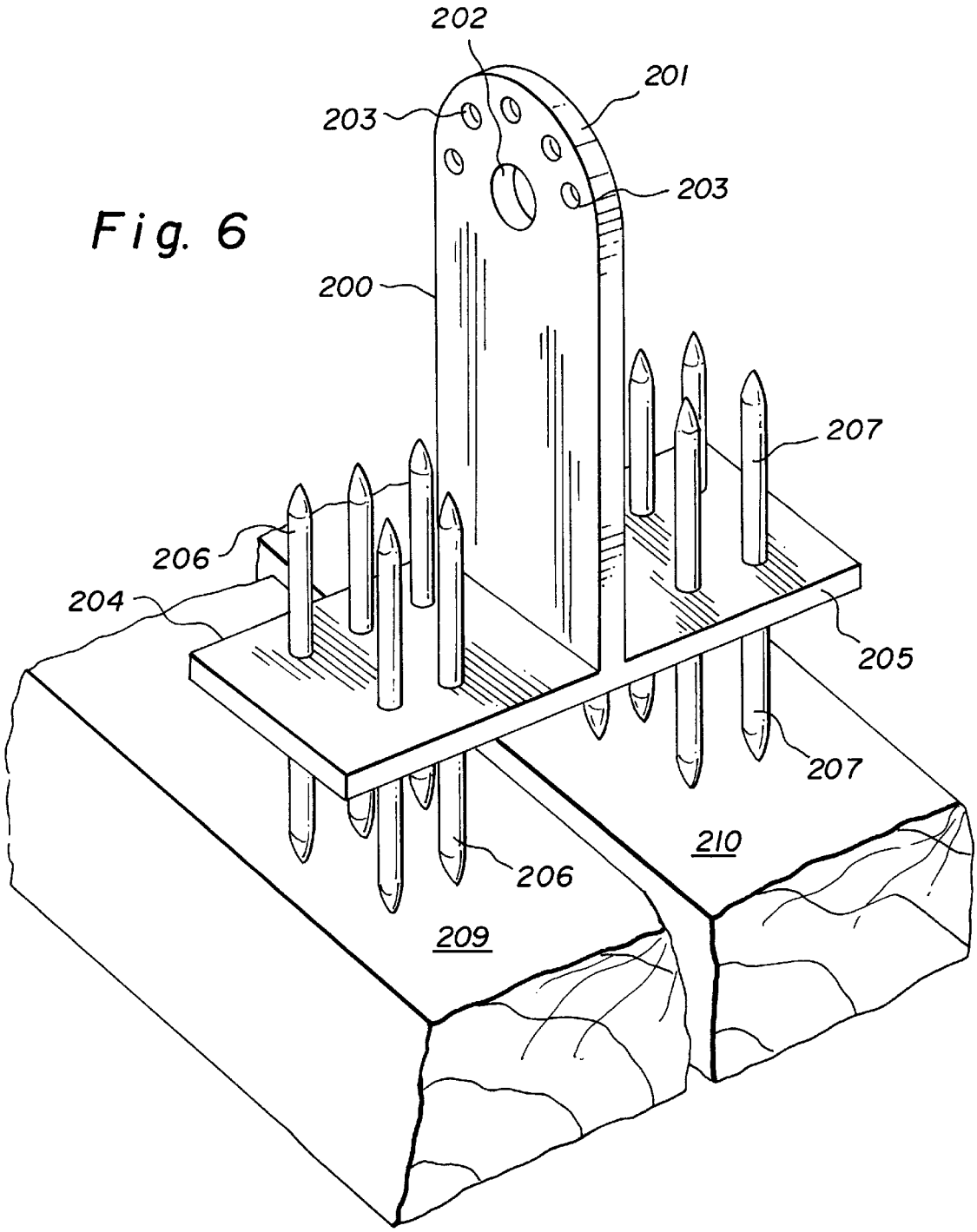

FIG. 6 shows a connector plate 200 which is used to four wood components as in a columns. Plate 200 has a rounded portion 201 which has a center bolt hole 202 and adjustment holes for receiving a shear pin or the like designed to maintain the connection in a given angle. The lower end of plate 200 has "T" shaped extension portions 204 and 205 in which are located a series of two/three pattern securement nails 206 and 207, respectively, for securing the plate to laminate sections 209 and 210 of a double column. The corresponding portions of each member are not shown but would be secured to the upwardly extending nail adjacent the connector portion 201 of the plate 200. This plate can be used in conjunction with other plate configurations described in the specification and may be modified to include another bolt pattern extension which would be parallel to laminate portions 209 and 210. Portion 201 may be square with a rectangular four hole bolt pattern if that is required or desired.

Figure 7C:
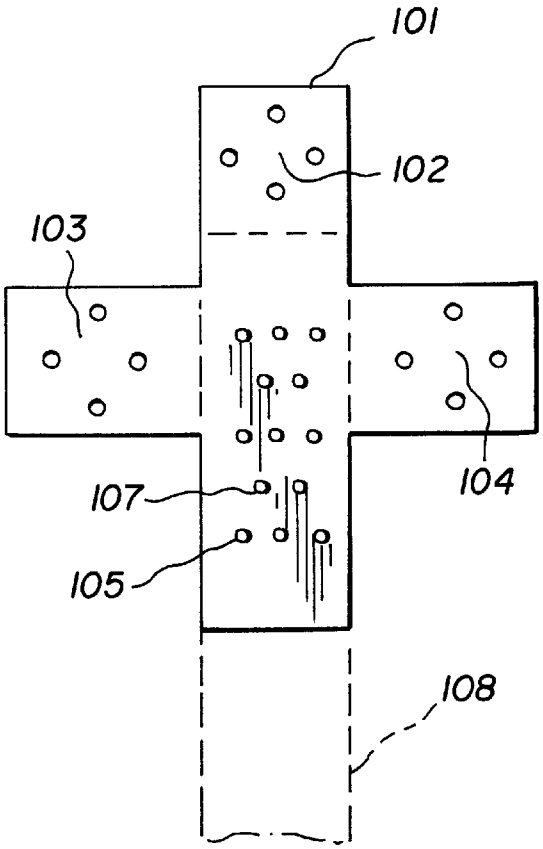
Figure 7B:
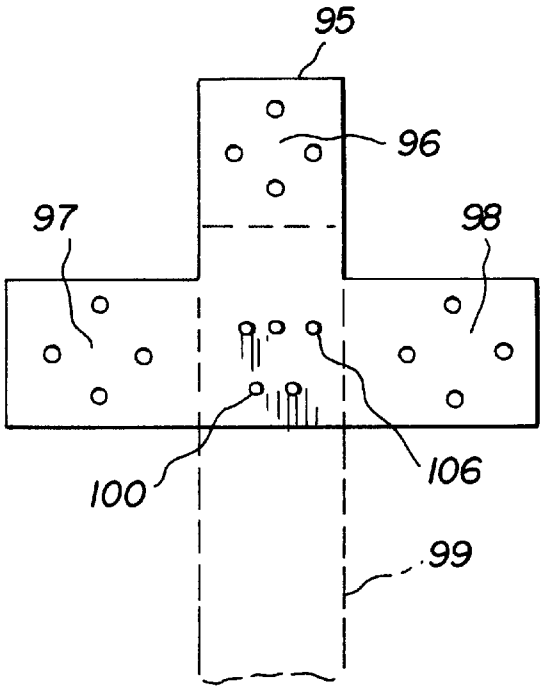
Figure 7A:
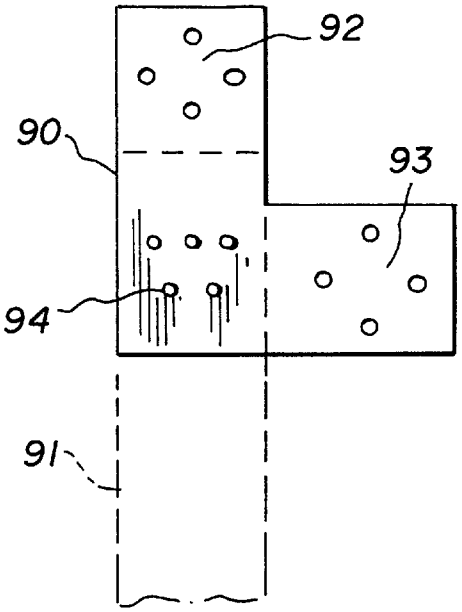

FIG. 7 shows three type of connector plate configurations generally designated as FIG. 7*a*, the "L" plate, FIG. 7*b*, the "T" plate and FIG. 7*c*, the "Cross" plate. In the "L" plate the ends have bolt hole patterns 92 and 93, which form a loose square, tilted at a 45 degree angle to the edge of the squared off ends and member 91. These patterns align with patterns in other component plates to receive four securing bolts to bolt the plates and members together. Nails 94 in a two/three pattern as shown secure the plate to the member. FIG. 7*b* shows a "T" plate 95 having bolt patterns 96, 97 and 98 arranged thereon so as to allow three connections to other members. Nails 100 in a three/two pattern arranged across the grain of member 99 secure it thereto. The final plate configuration shown as the "Cross" in FIG. 7*c* has plate 101 secured to member 108 by alternating lines of nails 107, 105 in a two/three configuration, respectively. Bolt patterns 102, 103 and 104 are located on the squared off ends of the plate and are adapted to mate with corresponding patterns on other plate members. This configuration is used where there is to be a lot of stress on the connection and it is designed to resist this stress whether it be torsional or separation forces.

Figure 8:
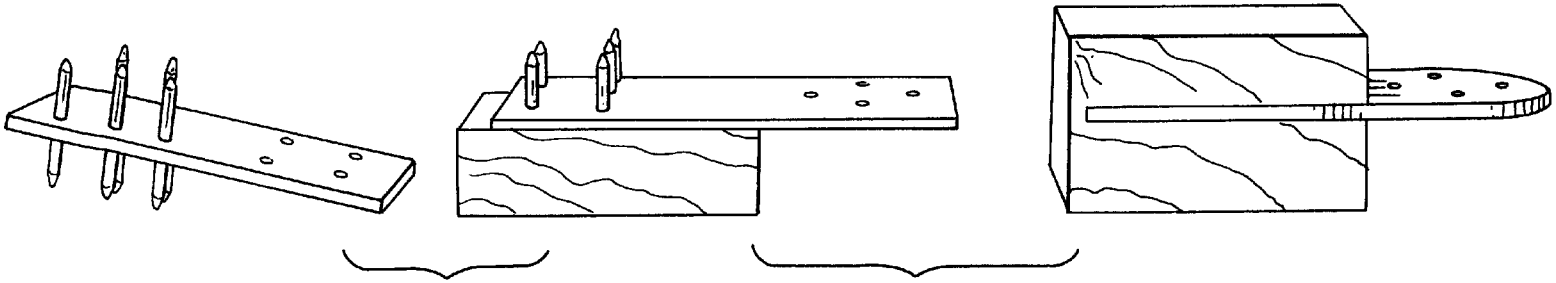
Figure 10:
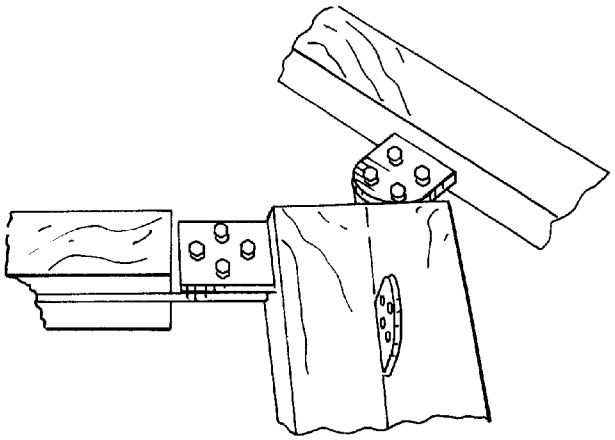
Figure 9:
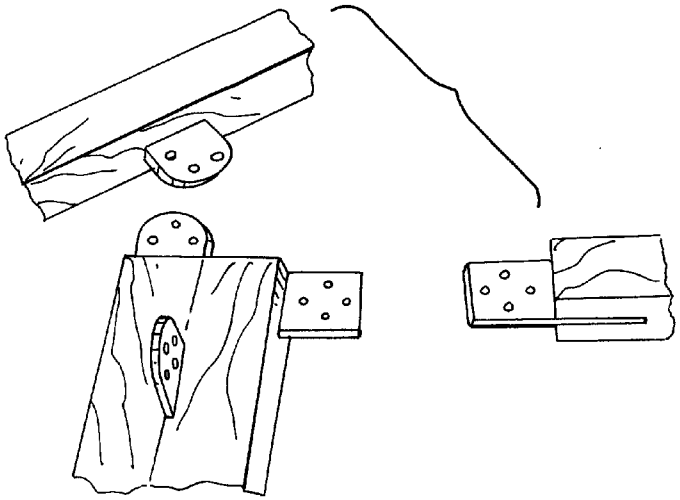
Figure 11:
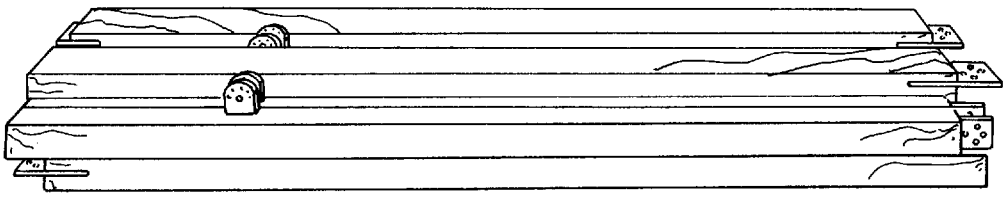
Figure 12:
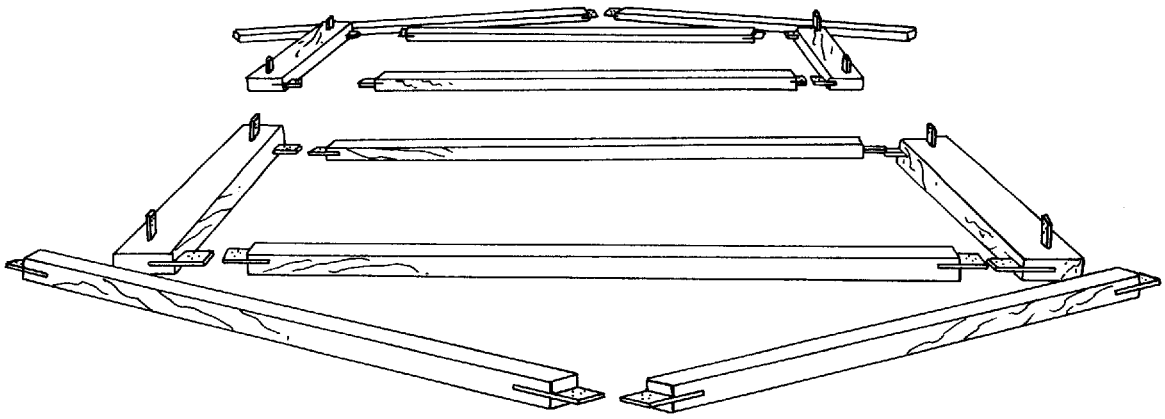
Figure 13:
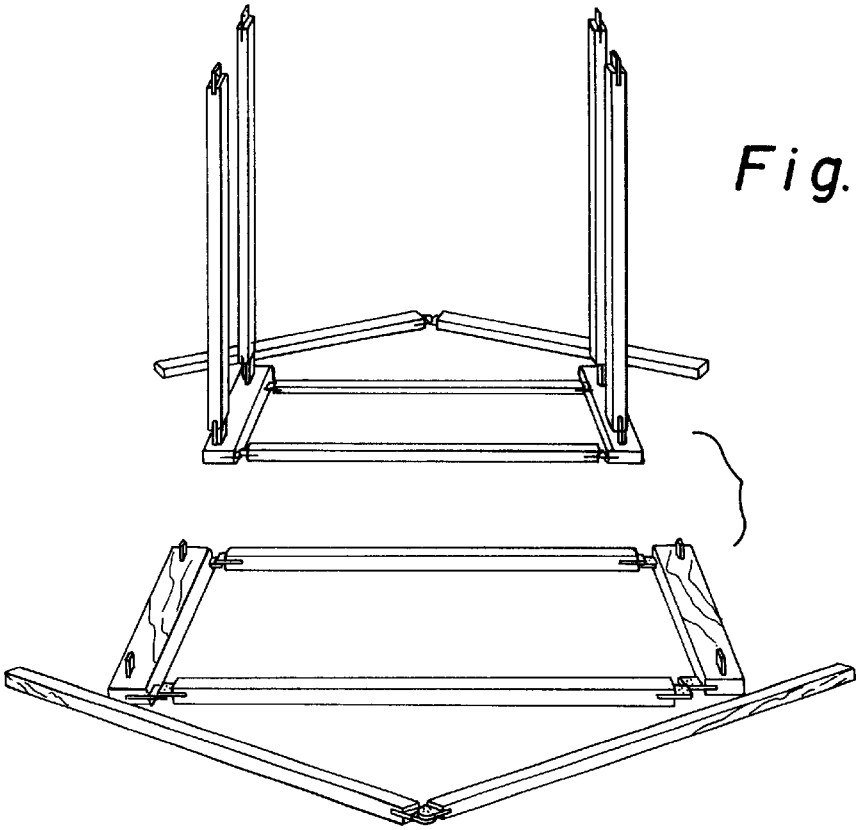

Having described the basic components attention is directed to FIGS. 8 through 15 which show photographs of the basic system and how it is assembled. FIG. 8 shows the stages of component fabrication using the RTA (Ready To Assemble) connector. The connector plate with the nails is driven into on laminate section of a member and then the second laminate section is pressed atop the partially assemble connector. Naturally, this is done at both ends of the member simultaneously resulting in a completed member ready to assemble. The strong connector plates serve to hold the laminate sections together in a rigid manner and provide the strength of a solid wood member of the same cross section. FIG. 9 shows the components ready to assemble in a manner as described in FIG. 4 but with a diamond bolt pattern. FIG. 10 shows the components of FIG. 9 bolted together. FIGS. 11 through 14 show the components as they are packaged and arrive on site, how they are laid out and partially assembled and how they look in an assembled shed frame. Note there are four comers assembled as in FIGS. 9 and 10, which use four double column members. The construction system is factory fabricated and site assembled. There is no cutting of members nor nailing thereof. FIG. 15 shows the use of presized manufactured panel members being used to enclose the space shown by FIG. 14. Each panel 110 is designed to clip to one another by H-shaped clips 111, to the columns 115 by clips 112 and the top chord members 116 by clips 113. Alternatively, the panels may be screwed or nailed to the members but such a step renders the structure permanent with possible damage to the members if disassembly takes place. Regular construction sheathing may alternately be employed if desired. The shed shown in the photographs is of 8×8×12 foot dimensions.

Having described the invention, it will be obvious to those of ordinary skill in the construction art that many changes and innovations may be made to the invention without departing from the scope of the appended claims in which:

1. An improved ready to assemble construction system, said system comprising multiple elongated members, each member having separate connecting means on the ends thereof and integral therewith and designed to secured to one another by fastening means, fastening means for securing the ends of said elonoated members to one another to form a structure, and wherein each elongated member is composed of two or more laminate sections and said separate connecting means holding said laminate sections together to form said elongated members.

2. A construction system as in claim 1 wherein said separate connecting means comprise a connection portion and a securing portion, said securing portion holding said laminate sections together and said connection portion has apertures therein receiving said fastening means.

3. A construction system as in claim 2 wherein said securing means comprises a plurality of nails extending from said securing portion and engaging said laminate sections to said connection portion and to one another.

4. A construction system as in claim 3 wherein said nails are positioned in securing portion in two parallel rows of three/two nails.

5. A construction system as in claim 4 wherein said elongated members and said laminate sections are wood having a grain and said nail rows are perpendicular to the grain of the wood.

6. A construction system as in claim 2 wherein said connection portion has a central hole therein receiving said fastening means and pivoting lock means thereon to prevent rotation of said connection portion relative to said fastening means or another connection portion of another elongated member.

7. A construction system as in claim 1 in which certain elongated members are configured as column members, others as top chord members and still others as truss members.

8. A construction system as in claim 1 including at least one laminate portion on at least one elongated member being routed to form a recession to accept said connecting means between that portion and an accompanying laminate portion.

9. A connecting plate securing at least two elongated laminated sections together to form an elongate member and configured to engage other connecting plates on other elongated members and, by the use of fasteners, secure said members together to form structures, said plate comprising a securing portion having attachment means thereon to secure said laminate sections to said plate and to each other, a connecting portion thereon having connecting means for receiving fasteners securing said elongate members together, wherein said plate secures multiple elongated members together to form structures.

10. A plate as in claim 9 wherein said plate is metal with the securing portion and the connecting portion coextensive.

11. A plate as in claim 9 where said attachment means comprises a plurality of doubled ended nails secured to said securing portion at their centers and extending in opposite directions to engage said laminate sections to be secured together and wherein said laminate sections are wood with a grain.

12. A plate as in claim 11 wherein said nails are configured in a pattern perpendicular to the grain of the laminate sections to be secured together.

13. A plate as in claim 10 wherein said connecting means comprises at least one hole in said connecting portion and a series of shear pin holes surrounding said hole designed to accommodate a shear pin to prevent rotation of said connecting portion relative to said fastener and another elongated member connecting portion.

14. A plate as in claim 9 wherein said securing portion includes two such portions extending in different directions and said connecting portion extends in a third direction from said two securing portions.

15. A plate as in claim 9 wherein said securing portion is a flat portion extending between two laminate sections and with apertures therein to accept attachment means securing said plate between said laminate sections.

16. A plate as in claim 15 wherein said connecting portion is a flat portion extending beyond the ends of said laminate sections and having a hold located centrally therein receiving a fastener to secure it to another plate connecting portion to hold one elongated member to another.

* * * * *